US005301488A

United States Patent [19]

Ruhl et al.

[11] Patent Number: 5,301,488

[45] Date of Patent: Apr. 12, 1994

[54] PROGRAMMABLE FILLING AND CAPPING MACHINE

[75] Inventors: Mark A. Ruhl; Richard C. Jensen, both of Baltimore, Md.

[73] Assignee: National Instrument Company, Inc., Baltimore, Md.

[21] Appl. No.: 972,809

[22] Filed: Nov. 6, 1992

[51] Int. Cl.[5] ..... B65B 3/34; B65B 7/28; B65B 57/00; B65B 59/00

[52] U.S. Cl. ..... 53/55; 53/75; 53/282; 53/306; 53/317; 53/319

[58] Field of Search ..... 53/51, 503, 75, 306, 53/317, 319, 368, 170, 282, 283, 268, 284.5, 272, 276, 55, 471; 141/235, 260, 227

[56] References Cited

U.S. PATENT DOCUMENTS

| | | | |
|---|---|---|---|
| 2,726,028 | 12/1955 | Saumsiegle | 53/317 |
| 3,212,231 | 10/1965 | Pechmann | 53/317 X |
| 3,964,240 | 6/1976 | Evrard | 53/306 |
| 4,159,608 | 7/1979 | Masuda et al. | 53/282 |
| 4,498,275 | 2/1985 | Baron | 53/282 X |
| 4,535,583 | 8/1985 | Tanaka et al. | 53/75 |
| 4,554,774 | 11/1985 | Miyashita et al. | 53/282 X |
| 4,614,077 | 9/1986 | Muto et al. | 53/317 X |
| 4,616,466 | 10/1986 | Tanaka et al. | 53/75 |
| 4,756,137 | 7/1988 | Lanigan | 53/306 X |
| 5,177,930 | 1/1993 | Harston et al. | 53/55 |

*Primary Examiner*—Horace M. Culver
*Attorney, Agent, or Firm*—Barnes & Thornburg

[57] ABSTRACT

A filling and capping machine including a computer controlled turret having a plurality of pockets for positioning a plurality of containers to at least a fill position and a capping position along the turret's path. The controller programmably positions the turret to these positions for variations of the locations of the pockets on the turret and accommodates for variations in the size and number of the container pockets and the type of fill product and type of containers. The controller also controls the position of the filling unit for the type of fill product as well as controlling the positioning of the filling unit and the capping unit for variations in the type of container. The controller uses a combination of servo motors and fluid motors to vertically and rotationally position the elements.

20 Claims, 5 Drawing Sheets

PROGRAMMABLE FILLING AND CAPPING MACHINE

TECHNICAL FIELD

The present invention relates generally to filling and capping machines and more specifically to a mono-block, programmable filling and capping machine.

BACKGROUND ART

The filling process generally includes providing a supply of containers along a conveyer, filling the containers at a filling position, and closing the containers at a closing and capping position. This process may produce by separate and distinct filling and capping machines or may include a single or mono-block machine which conveys, fills and caps. Depending upon the structure, the conveying system may be a linear conveyor or may be a combination of a linear conveyor with a circular conveyor or turret. In the turret system, the containers are positioned at the filling and capping stations along the turret.

The method of filling and transporting or conveying is generally the function of the type and size of the container as well as the fill product. For liquids in wide mouthed containers, spilling during transport is a problem which must be addressed. There are many various solutions in the prior art to address this problem and they generally include different acceleration, deceleration cycles as well as velocity as the containers move between the various stations. If the fill product is a foamy product, the fill sequence is different than a non-foamy product. Some products are filled bottom to top, others are filled from the top down. Thus, the vertical position of the filling nozzle must be continually adjusted for the type of product to be filled. Similarly, the vertical positions of the filling nozzle as well as the vertical position of the capper must be adjusted for various heights of containers. Since the prior art used mechanical drives for the filling and capping unit using cams and other linkages, a considerable amount of time was needed to readjust the machine for different types of fill product and containers.

The conveying system also includes cams, mechanical linkages, to determine the position of the containers on the conveyor. In the turret conveying system, industry has used a indexer which indexes twelve positions about the 360° of rotation of the turret. Thus if more container pockets are to be included on the turret, the fill and capping position had to be adjusted with respect to the turret, or the diameter of the turret had to be increased to accommodate the positioning of the additional pockets. Again, this required mechanical modification of the machine for pocket locations whether it be the number of pockets or the size of the pockets. Thus, if the shape or diameter of the container changed, the turret itself or the location of the capping and filling devices had to be adjusted mechanically. Other stations may be provided along the path including a plug insertion device as well as a cap tightening device.

DISCLOSURE OF THE INVENTION

Thus it is an object of the present invention to provide a filling and capping machine which can accommodate and adjust itself for various containers and fill product without substantial mechanical modification.

Another object of the present invention is to provide a filling and capping machine which can accommodate various containers and fill product with a minimum amount of change over time.

A still even further object of the present invention is to provide a filling and capping machine which is capable of positioning the turret to accommodate container and fill product variations.

These and other objects are achieved by providing a computer controlled turret having a plurality of pockets for positioning a plurality of containers to at least a fill position and a capping position along the turret's path. The controller programmably positions the turret to these positions for variations of the locations of the pockets on the turret. This accommodates for variations in the size and number of the container pockets. The controller also programmably operates the turret at predetermined speeds for variations in the type of fill product and type of containers. The controller also controls the position of the filling unit for the type of fill product as well as controlling the positioning of the filling unit and the capping unit for variations in the type of container. The controller uses servo motors to position the turret, the filling unit and the capper. Preferably the vertical position of the filling unit and the capper are controlled by servo motors. The angular position of the capper to retrieve caps from a pickup position to a capping position is controlled by a fluid motor. Similarly, a plugging unit may be included and operated similarly to the capping unit, wherein the controller provides a servo motor for the vertical movement for the plugging unit and a fluid motor to rotate the plugging unit from its plug pickup position to its plugging position. A cap tightening unit may also be provided along the path of the turret to tighten the caps initially started by the capping unit. The tightening unit is controlled vertically by a first motor and the twisting position by a second motor. Preferably the first motor is fluid and the second motor is a servo motor. A torque sensor is provided to control the twisting servo motor. The capping unit includes a second motor to twist the cap on during the vertical travel of the capping unit. A vacuum device is used for holding and releasing the cap and the plug. The servo motors are connected to the filling unit and the capping unit by ball and screw drives. The servo motor for the conveyor is connected through a gear reducer to extend the fineness of positioning and range of speeds of positioning of the turret.

Other objects, advantages and novel features of the present invention will become apparent from the following detailed description of the invention when considered in conjunction with the accompanying drawings.

BEST MODES FOR CARRYING OUT THE INVENTION

Figure 1:
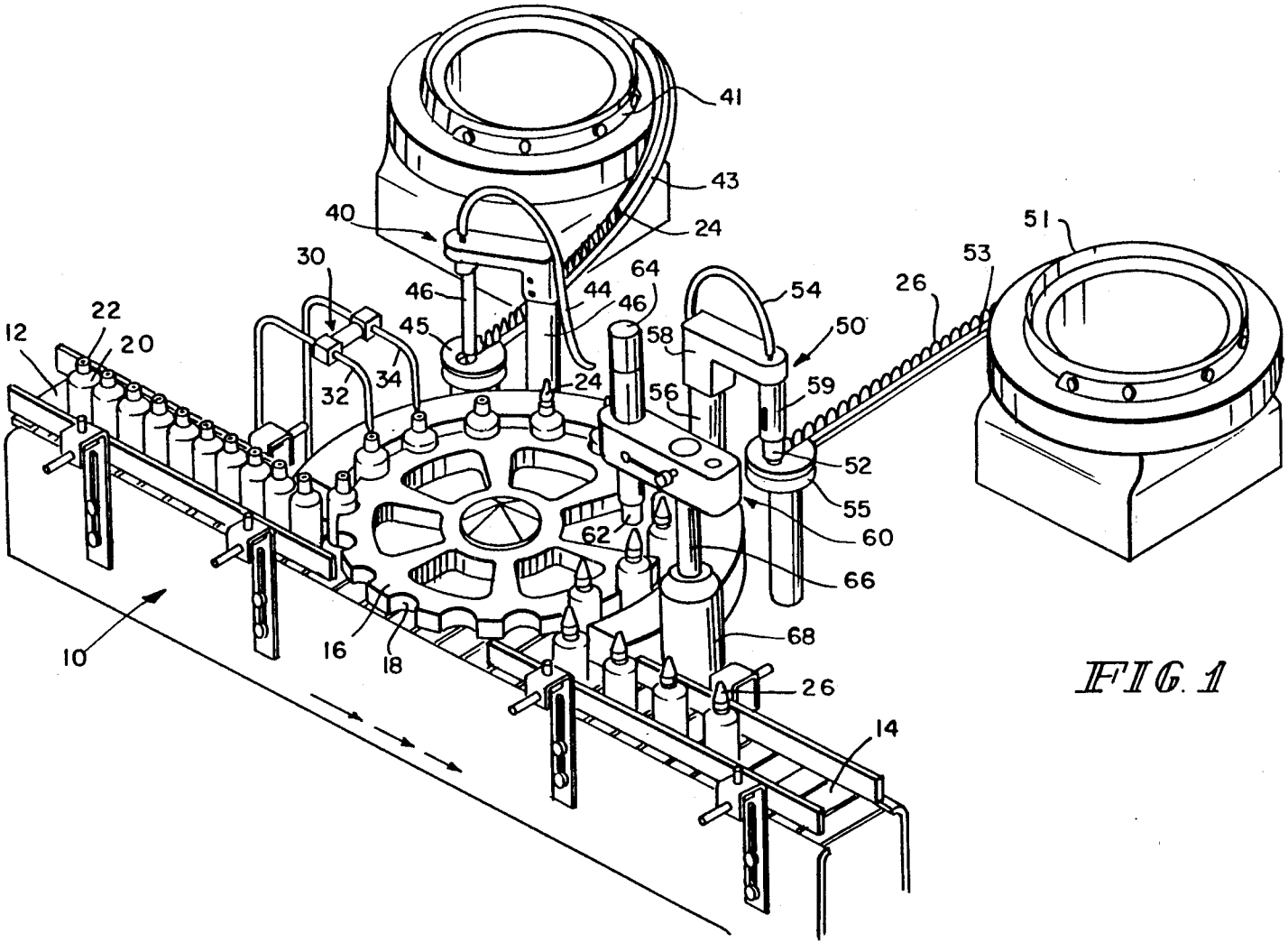
FIG. 1 is a perspective view of a filling and capping unit according to the principals of the present invention.

A filling and capping machine, as illustrated in FIG. 1, includes a conveyor 10 having a linear portion 12 and 14 bringing containers 20 to and from a turret 16. A plurality of container pockets 18 are provided in the turret 16. The container 20 includes an opening 22 which is filled at a filling station by filling unit 30, a plug 24 inserted at a plugging station 40, a cap 26 placed on the plug and partially twisted by capping unit 50 and the cap 26 is tightened by tightening unit 60. A controller, to be discussed in detail in FIG. 8, coordinates the operation of conveyors 12, 14 and turret 16 to position the containers 20 at the appropriate stations. The controller also controls the positioning and operation of the filling unit 30, plugging unit 40, capping unit 50 and twisting unit 60.

The filling unit 30 is illustrated as including two nozzles 32 and 34 such that two containers can be filled for one indexing of the turret 16 each filling unit and nozzle fills a portion of each container. This is for the purpose of example only, and more or fewer containers may be filled with a corresponding number of filling heads or nozzles. It should be noted that the positions of the various units in FIG. 1 are at the beginning of the sequence after the turret 16 has indexed the containers 20 one position. The filling unit 30 is lowered and it is operated to dispense fluids into the containers 20. Depending upon the kind of materials to be dispensed the nozzles 32 and 34 may be positioned at the top of the container for filling during the complete filling cycle or may be positioned at the bottom of the container for a bottom fill during the complete filling cycle or may, to be moved during the filling cycle. This will depend upon the type of fill product.

The plugging unit 40 includes a vibratory feed bowl 41 for transporting plugs 24 down a track 43 to the nest 45. A pickup head 42 operated by vacuum line 44 holds and releases a plug 24. The vertical and angular position of the head 42 is controlled by mechanism 46.

The capping unit 50 similarly includes a vibratory bowl 51 for transmitting caps 26 down feed track 53 to a nest 55. The cap pickup at 52 is also operated by a vacuum line 54 to retain and release a cap 26. Mechanism 64 controls the vertical and angular positions of the head 52. A mechanism 58 controls the rotational position of a separate twisting drive 59 provided on the capping unit 50 to partially twist-on the cap during the vertical downward motion.

The twisting unit 60 includes a twisting head 62 driven by driver motor 64. The vertical position of the head 62 is controlled by rod 66 extending from a piston cylinder 68. The motor 64 twists-on and tightens the cap and is controlled to a desirable degree of torque. A torque sensor, not shown, is also included to monitor the amount of torque.

Figure 2:
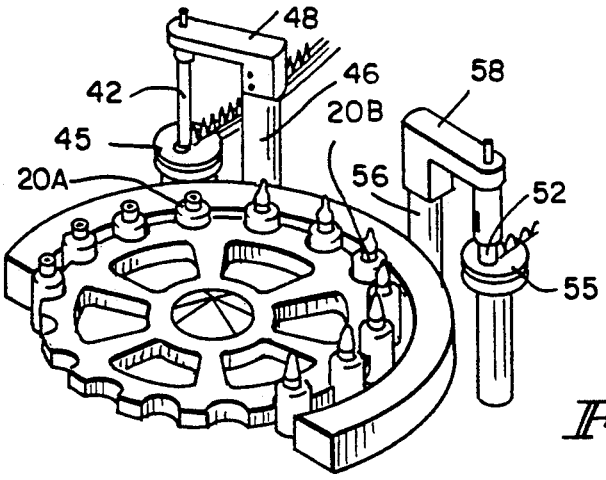
FIGS. 2 through 7 illustrate the sequence of the operation of the plugging and capping unit from retrieving a plug and cap in FIG. 2 to inserting a plug and cap, and finally returning to a preset position at the beginning of another cycle.
Figure 3:
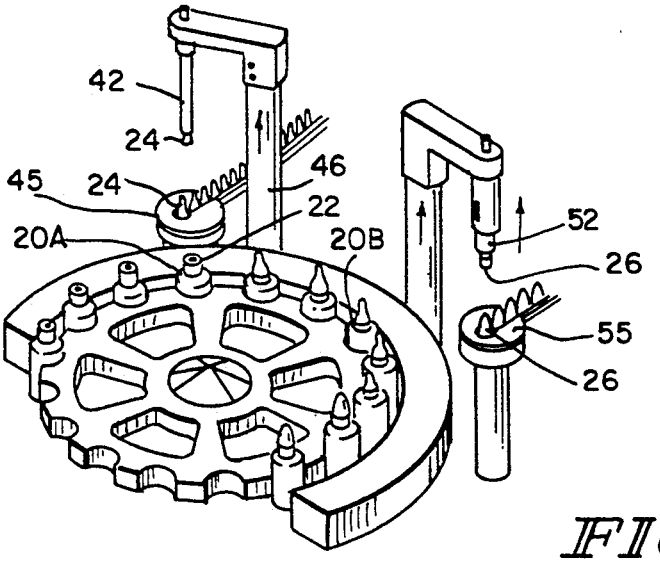
Figure 4:
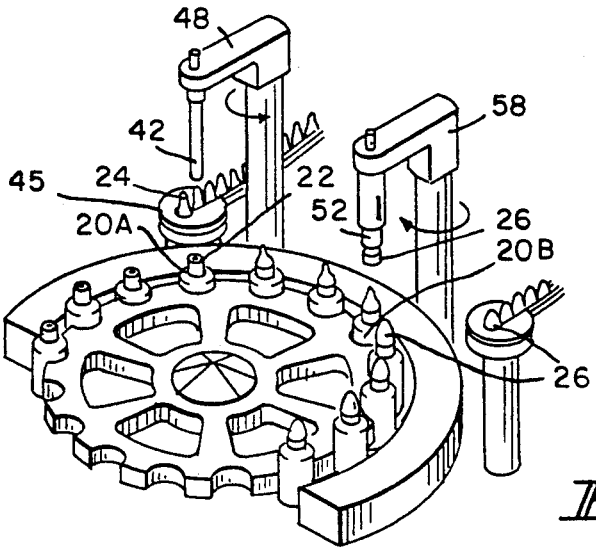
Figure 5:
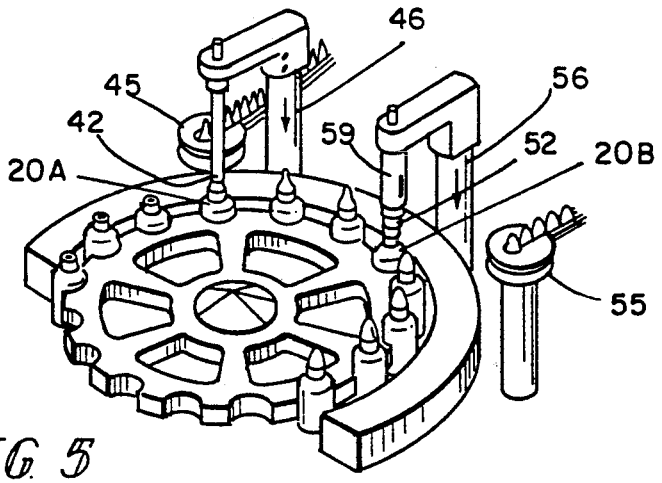
Figure 6:
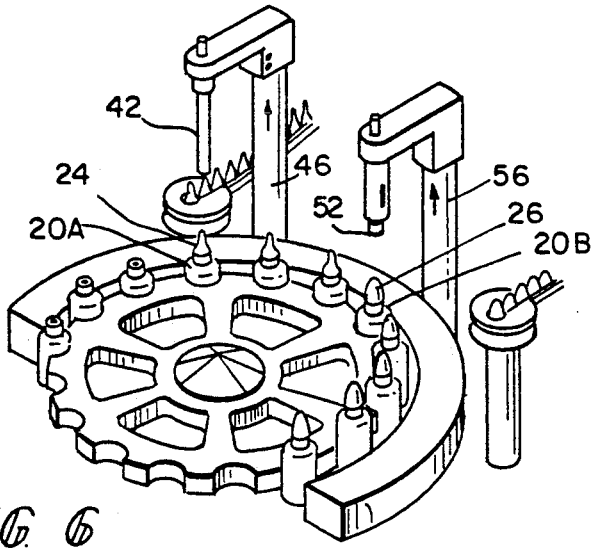
Figure 7:
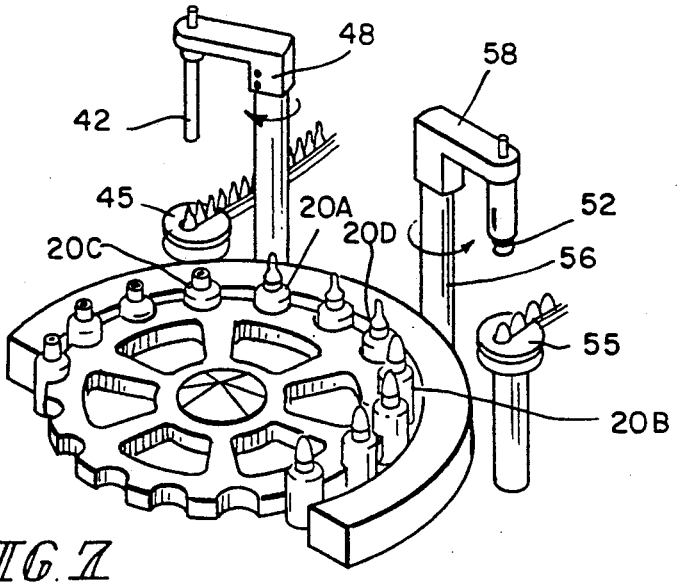

The sequence and operation of a filling unit 30 and a twisting unit 60 are well known and therefore are not described in substantial detail. The operation of the pick-n-place mechanism of the plugging unit 40 and the capping unit 50 will be described in detail with respect to FIGS. 2 through 7. As illustrated in FIG. 2, a container 20 A is at the plugging station and container 20 B is at the capping station. The mechanism 46 and 56 have lowered the heads 42 and 52 respectively to the nest 45 and 55 to pickup a plug 24 and a cap 26 respectively. The vacuum lines are activated to retain a plug or a cap in the head 42 and 52 respectively. The mechanisms 46 and 56 then raise the head with the retained plug and cap as illustrated in FIG. 3. The mechanisms 46 and 56 rotate the heads 42 and 52 from the pickup position of FIGS. 2 and 3 to the plugging and capping positions illustrated in FIG. 4. The mechanisms 46 and 56 then lower the heads 42 and 52 to insert the plug into container 20A and to insert and twist on a cap on container 20B as illustrated in FIG. 5. During the downward movement of mechanism 56, driver 59 is actuated to turn the cap at least one turn such that it does not fall off during movement of the turret 16. The vacuum lines are then deactivated allowing the heads 42 and 52 to release the plug and cap respectively. Mechanisms 46 and 56 then raise the head as illustrated in FIG. 6 and rotate the heads from the plugging and capping positions of FIG. 6 to the pickup positions as illustrated in FIG. 7. Mechanisms 46 and 56 then lower the head to pickup a plug 24 and a cap 26 respectively, as illustrated in FIG. 2. As shown in FIG. 7, as the heads 42 and 52 are rotated from their plugging and capping position to their pickup position, the turret 16 indexes a new container 26C to the plugging position and a new container 20D to the capping position.

Figure 8:
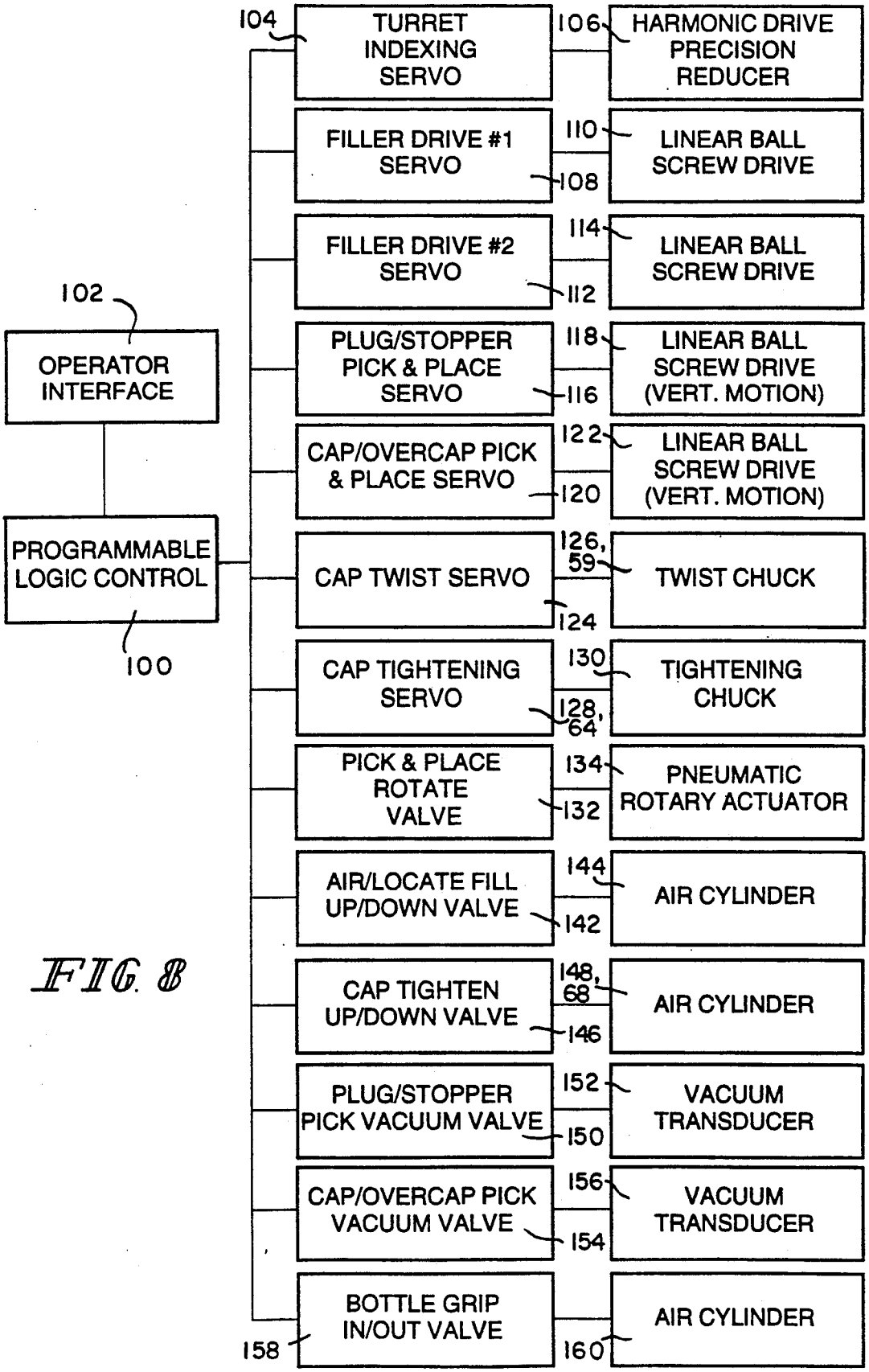
FIG. 8 is a schematic of the control system of the present invention.

The control system, illustrated in FIG. 8, includes a programmable logic controller 100 having an operator interface 102. The programmable logic controller 100 includes a plurality of parameters and programs to fill and cap different fill product into a variety of containers. The speed of the conveyor, the positioning of the conveyor, the positioning and cycles of the filling unit 30, the plugging unit 40, the capping unit 50 and the twisting unit 60 are all variably controlled from the programmable logic controller 100. The information for product and container may be pre-stored and selected or may be individually entered. The use of a programmable logic controller 100 allows for programmable selection of the different portions, operation and positioning of the elements without any mechanical modification. Substituting a different turret 16 with different shaped pockets is the only mechanical variation needed for a container modification. The rotary positioning of the turret for variations in the size and location of the pockets are all modified electrically. The positioning of the turret 16, the vertical positioning of the filling unit 30, the plugger 40 and the capper 50 are all controlled by servo motors. This provides accurate positioning.

The program logic controller 100 controls the turret index servo 104 which is connected to the turret 16 by a precision reducer 106 available from Harmonic Drive. This is a high precision reducer which extends the fine positioning of the turret as well as increasing the speed range. A first filling drive servo 108 is connected by linear ball screw drive 110 to the filling unit of the filling head 32. A second filling drive servo 112 is connected through ball screw driver 114 to operate the filling unit of filling head 34. If the filling unit is a piston pump, the servos control the velocity, the length of travel of the piston pump. By providing independent control of the two different filling heads, and using a single position rotation per index, the first filling head 32, for example, may fill very quickly two-thirds of the container wherein the last filling head 34 at a slower rate can fill the last one-third of the container.

A plug-stopper pick-n-place servo 116 through linear ball screw drive 118 controls the vertical mechanism 46 of the plugging unit 40. A cap/over-cap pick-n-place servo 120 through linear ball screw drive 122 also controls the mechanism 56 to adjust the vertical position of the capping unit 50. A cap servo twist 124 through twist chuck 126, which is 59 in FIG. 1, drives the pre-twisting of the capping head 52. A cap tightening servo 128, which is motor 64 in FIG. 1, through tightening chuck 130 twist the bottle tight at the tightening station 60. These servos thus far described are DC servo motors and are the electrical portion of the system.

The pneumatic control portion of the system includes a pick-n-place rotary valve 132 controlled by the programmable logic controller. The valve 132 through pneumatic rotary actuator 134 controls the angular position of the plugging unit 40 and the capping unit 50. The air/locate fill up and down valve 142 through air cylinder 144 raises and lowers the filling heads 32 and 34 and also monitors whether a container is under the filling head before allowing the controller 100 to activate the filling units. Cap tightening up down valve 146 through air cylinder 144, which is illustrated in FIG. 1 as 68, moves the capping tightening unit up and down. The plug/stopper pick up vacuum valve 150 through vacuum transducer 152 retains and releases the plug at the head 42. Similarly the cap/over cap pickup vacuum valve 154 and vacuum transducer 156 retains and releases caps at head 52. A bottle grip and an out valve 158 through air cylinder 160 retains and releases the bottles or containers 20 within the turret 16 at the tightening position of tightening unit 60.

Although the pick-n-place rotation of the plugging and capping unit and the up/down motion of the nozzles 32 and 34 and the tightening station 60 are shown as pneumatic motors, they can also be replaced by electrical servos. This would be a function of economy and accuracy needed for these positionings.

Figure 9:
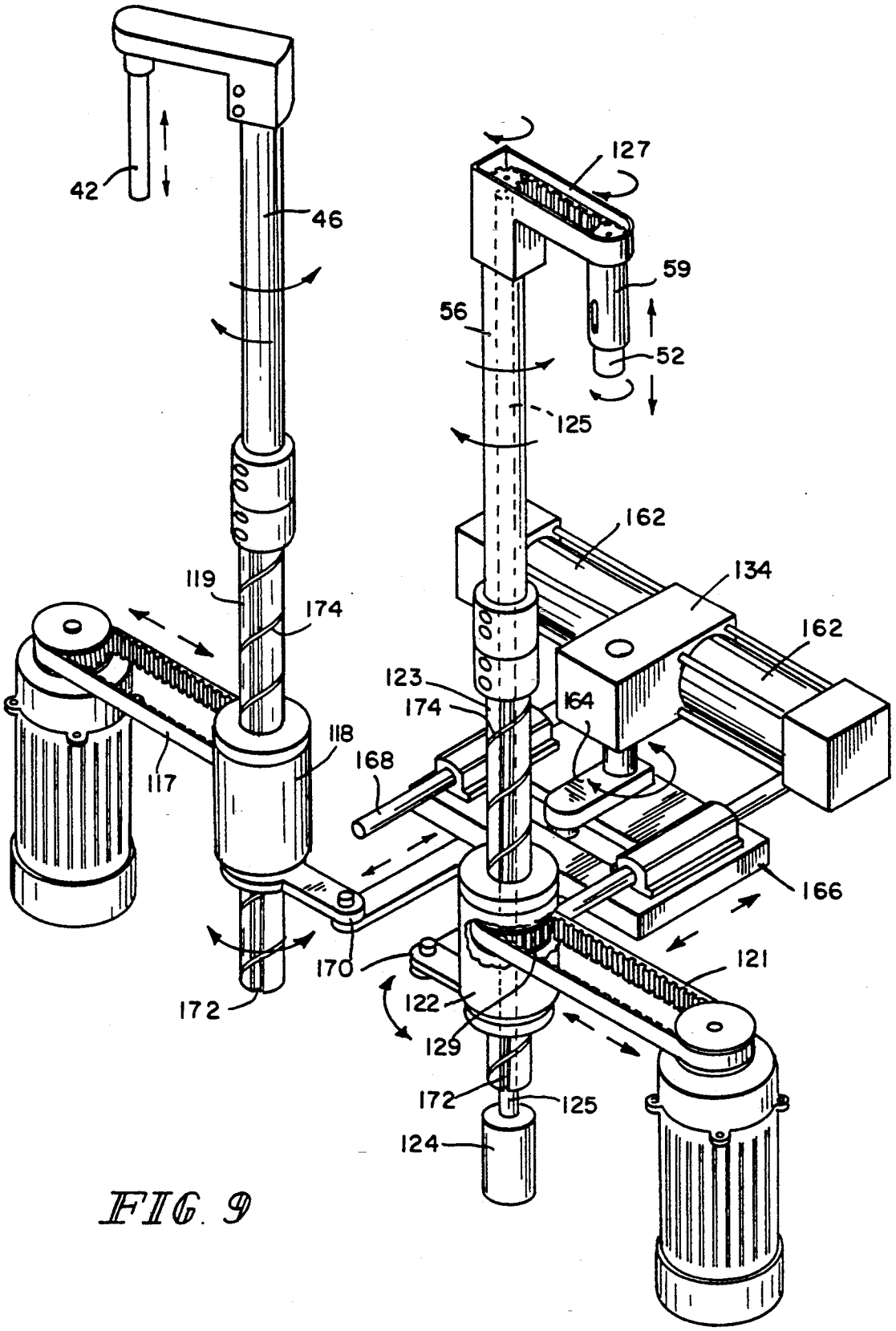
FIG. 9 is a perspective view of the vertical and rotation motion elements used with the plugging and capping units according to the principles of the present invention.

A more detailed description of the pick and place drive for the plugging station 40 and the capping station 50 is illustrated in FIG. 9. The servo motor 116 is connected to the ball screw drive 118 by belt 117. A pulley, like pulley 129 of ball screw drive 122, drives the screw 119 vertically through a ball mechanism, not shown, to raise and lower element 46 of the plugging unit. The ball rotates in spiral race 174 of screws 119. Similarly, the servo 120 drives the ball screw driver 122 by pulley 129 and screw shaft 123 of mechanism 56 of the capping unit. The cap twisting servo 124 is connected to shaft 125 to drive the twisting chuck 59 via gear train 127. The cap twist servo 124 may be turned on and off or it may be continuously rotated.

A common pick-n-place rotary valve controls the pneumatic rotary valve actuator 134 which includes a pair of pistons 162. The pistons 162 move the rotary valve actuator 134 to rotate actuator 164. The rotation of 164 is translated to linear motion to drive sled 166 on rails 168. Levers 170 connect the sled 166 to the screws 119 and 123 of the screw drives 118 and 122 respectively in vertical splines 172. This rotary motion rotates the plug head 42 and the cap head 52 between their plugging and capping positions and their pick up positions. Since the rotation is produced through screws 119 and 123, the computer compensates for any resulting vertical motion produced during the rotation between the various positions. It should be noted that since screws 119 and 123 rotate in opposite directions, opposite compensations must be mathematically produced.

As previously discussed, by using a programmable logic controller 100, various product fill and various size containers may be used. Also, a turret 16 with a different number and placement of pockets may also be used. Although the example used is a indexing of a single pocket or container per index, multiple indexing may be conducted. The through-put capacity of the system can be increased, by doing a double pocket or container index per index. This would require doubling the operations at each station. In some situations, where a plugger is not used, additional space around the periphery of the turret is available. The present system uses a separate capper 50 and twister 60 so as to decrease the dwell time during an index at the capper 50. If through-put is not a concern, the capper 50 can also produce enough torque to tighten the cap and thereby eliminate a separate mechanism for the tightening.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A filling and capping machine comprising:

a conveyor means for positioning a plurality of containers at a plurality of positions along a path;

a filling means, raised and lowered at a filling position along said path, for filling a container at said filling position;

a capping means, pivoted about a first axis between a capping position on said path and a cap pickup position, and raised and lowered at said capping position, for retrieving a cap at said cap pickup position and capping a container at said capping position; and control means, including a servo motor connected to each of said conveyor means, said filling means and said capping means, for programmably positioning said conveyor means, said filling means and said capping means.

2. A machine according to claim 1, wherein said servo motors are DC motors.

3. A machine according to claim 1, wherein said control means includes a second servo motor connected to said capping means for twisting said cap on to said container during lowering of said capping means.

4. A machine aceording to claim 1, including plugging means, pivoted about a second axis between a plugging position on said path and a plug pickup position, and raised and lower at said plugging position, for retrieving a plug at said plug pickup position and plugging a container at said plugging position; and said control means includes a servo motor connected to said plugging means for programmably positioning said plugging means.

5. A machine according to claim 4, wherein said capping means and said plugging means include vacuum means for holding and releasing a cap and plug respectively; and said control means operates said vacuum means.

6. A machine according to claim 1, wherein said control means also raises and lowers said capping means at said cap pickup position.

7. A machine according to claim 1, including tightening means raised and lowered at a tightening position along said path for tightening a cap on a container at said tightening position; and said control means programmably positioning said tightening means.

8. A machine according to claim 7, wherein said tightening means twist said cap to tighten it; and said control means includes a servo motor connected to said tightening means for programmably twisting said cap.

9. A machine according to claim 8, wherein said tightening means includes a torque sensor connected to said control means.

10. A machine according to claim 1, wherein said filling means includes a pump and a ball screw driver; and said control means includes a motor connected to said driver for programmably and variably operating said driver.

11. A machine according to claim 1, wherein said conveyor means includes a gear reducer connected to said servo motor for extending the fines of positioning and the range of speed of positioning of said conveyor means by said servo motor.

12. A machine according to claim 11, wherein said conveyor means includes a turret defining said path including said filling and capping positions and having container pockets; and said control means adjust the operation of the conveyor servo motor for variations of the location of said container pockets.

13. A machine according to claim 1, wherein said control means includes a fluid motor connected to said capping means for pivoting said capping means about said first axis and said servo motor raises and lowers said capping means.

14. A machine according to claim 1, wherein said control means includes ball-screw positioner connected to said servo motors of said filling means and said capping means.

15. A machine according to claim 1, wherein said control means positions said filling means and said capping means to predetermined vertical positions for variations in said containers.

16. A machine according to claim 1, wherein said control means positions said filling means to predetermined vertical positions for variations in said containers and fill product.

17. A machine according to claim 1, wherein said control means positions said filling means and said capping means to predetermined vertical positions for variations in said containers.

18. A machine according to claim 1, wherein said control means adjust the operation of the conveyor means for variations of the location of said containers on said conveyor means and type of containers and fill product.

19. A filling and capping machine comprising:

a conveyor means, including a turret having a plurality of container pockets, for positioning a plurality of containers at a plurality of positions along a path defined by said turret;

a filling means for filling a container at a filling position along said path;

a capping means for capping a container at a capping position along said path; and control means for programmably positioning said turret to said filling and capping positions for variations of the locations of said container pockets on said turret.

20. A machine according to claim 19, wherein said control means programmably operates said turret at predetermined speeds for variations in the type of fill product and containers.

* * * * *

UNITED STATES PATENT AND TRADEMARK OFFICE

CERTIFICATE OF CORRECTION

PATENT : 5,301,488

DATED : Apr. 12, 1994

INVENTOR(S) : Mark A. Ruhl and Richard C. Jensen

It is certified that error appears in the above-identified patent and that said Letters Patent is hereby corrected as shown below:

Column 7, line 16, (claim 11, line 3), change "fines" to --fineness--; and
Column 8, delete lines 9-12, claim 17.

Signed and Sealed this

First Day of April, 1997

*Attest:*

Bruce Lehman

BRUCE LEHMAN

*Attesting Officer*

*Commissioner of Patents and Trademarks*